US006406335B2

(12) United States Patent
Sato et al.

(10) Patent No.: US 6,406,335 B2
(45) Date of Patent: Jun. 18, 2002

(54) JOINT CONNECTOR

(75) Inventors: Kei Sato; Toshiaki Ozawa, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/811,622

(22) Filed: Mar. 20, 2001

(30) Foreign Application Priority Data

Mar. 21, 2000 (JP) ..... 2000-078329

(51) Int. Cl.[7] ..... H01R 13/514
(52) U.S. Cl. ..... 439/701
(58) Field of Search ..... 439/701, 928, 439/686–688, 717

(56) References Cited

U.S. PATENT DOCUMENTS 5,890,933 A * 4/1999 Okabe ..... 439/701
5,934,944 A * 8/1999 Aoyama et al. ..... 439/701
6,007,386 A * 12/1999 Okabe ..... 439/701
6,129,593 A * 10/2000 Aoyama et al. ..... 439/701
6,319,071 B1 * 11/2001 Sato ..... 439/701
6,332,811 B1 * 12/2001 Sato ..... 439/701
6,332,812 B1 * 12/2001 Kazuhara ..... 439/701

* cited by examiner

*Primary Examiner*—Gary Paumen
(74) *Attorney, Agent, or Firm*—Finnegan, Henderson, Farabow, Garrett, & Dunner, L.L.P.

(57) ABSTRACT

A joint connector is combined in plural stages by overlapping a front surface (3*a*) with a back surface (3*b*). In a temporarily placed state before connector housings (3) of the joint connector are combined, a combining projection portion (5) formed on the front surface (3*a*) comes into contact with an opening peripheral edge portion of a combining projection portion fitting hole (12) on the back surface (3*b*). Further, in the temporarily placed state, respective connector temporarily engaging surfaces (8*a*, 14*a*) of a front surface rear lock member (8) on the front surface (3*a*) and a back surface rear lock member (14) on the back surface (3*b*) come into contact with each other. Each of the connector housings (3, 3) keeps a parallel state in accordance with each of these contacts. In the temporarily placed state, at least a front end of a tab (19) is in a state of being inserted into a tab inserting hole (16).

11 Claims, 11 Drawing Sheets

JOINT CONNECTOR

BACKGROUND OF THE INVENTION

1. Field of the Invention

The present invention relates to a joint connector obtained by overlapping a plurality of connector housings having a uniform shape in plural stages. More particularly, the present invention relates to a joint connector which can prevent a tab from being deformed at a time of combination and can previously detect a combination error.

2. Description of the Related Art

As one example of a branching connector for branching a wire, there has been proposed a joint connector in which a plurality of connector housings having a uniform shape are overlapped with each other in plural stages so as to be combined (not prior art). On a surface 101*a* of the connector housing 101 constituting the joint connector mentioned above, as shown in FIGS. 1 and 3, a front engaging member 102, a rear engaging member 103, a front lock member 104 and a front surface rear lock member 105 are provided. On the contrary, on a back surface 101*b*, a front engaging member inserting hole 106 into which the front engaging member 102 is inserted, a rear engaging member inserting hole 107 into which the rear engaging member 103 is inserted, and a back surface rear lock member 108 engaged with the front surface rear lock member 105 are formed.

In order to combine both of the connector housings 101 and 101, as shown in FIG. 1, a back surface 101*b* of another connector housing 101 is opposed to and overlapped with the surface 101*a* of one connector housing 101. Then, as shown in FIG. 2, from a temporarily placed state before being combined, the connector housings 101 and 101 are combined so as to be held between an upper connector combining member 109 and a lower connector combining member 110.

The temporarily placed state before being combined corresponds to a state that the front lock member 104 comes into contact with a temporarily engaged surface 112 formed in a lower end of a front lock member engaging hole 111 for inserting and engaging the front lock member 104 as shown in FIG. 2, and in a rear portion thereof, as shown in FIG. 3, a connector temporarily engaged surface 108*a* on the back surface rear lock member 108 comes into contact with a connector temporarily engaged surface 105*a* on the front surface rear lock member 105.

When both of the connector housings 101 and 101 are combined from the temporarily placed state, the front engaging member 102 is inserted into the front engaging member inserting hole 106, and the rear engaging member 103 is inserted into the rear engaging member inserting hole 107, so that both of the connector housings 101 and 101 are positioned without being shaky in a longitudinal direction and a vertical direction.

Further, in front of the connector housing 101, the front lock member 104 is inserted into and engaged with the front lock member engaging hole 111, so that the housing front portion is locked. At the back of the connector housing 101, respective hook portions of the front surface rear lock member 105 are engaged with the back surface rear lock member 108, so that the housing rear portion is locked. Accordingly, both of the connector housings 101 and 101 keep a combined state without being separated from each other in a combining direction.

However, since heights between a front contact lock portion (a portion in which the front lock member 104 comes into contact with the temporarily engaged surface 112) and a rear contact lock portion (a portion in which the connector temporarily engaged surfaces 105*a* and 108*a* of the front surface rear lock member 105 and the back surface rear lock member 108 come into contact with each other) are different from each other, the connector housing 101 overlapped above is inclined forward as shown in FIG. 2.

Accordingly, when it is intended to combine both of the connector housings 101 and 101, there is a case that an unnatural contact is generated in the connected portion, a damage is generated in the combined portion or an incomplete combination of both of the connector housings is generated.

Further, as shown in FIG. 4, a tab inserting hole 114 extending a tab 113 of a terminal through a terminal receiving chamber 115 is formed on the back surface 101*b* in the connector housing 101. However, in the temporarily placed state shown in FIG. 2, a front end of the tab 113 has a certain distance L with respect to an opposite housing, and is in a state that the front end of the tab 113 is not inserted into the tab inserting hole 114.

Accordingly, when both of the connector housings 101 and 101 are combined with each other, there is a case that the tab 113 is not inserted into the tab inserting hole 114, so that the tab 113 is crushed and deformed. In particular, in the case that the connector housing 101 is largely inclined as shown in FIG. 2, the tab 113 is further hard to be received by the tab inserting hole 114. When the tab 113 is deformed without being inserted into the tab inserting hole 114, the tab 113 is held between the overlapping surfaces of the housings, so as to generate a combination error, so that an electric conduction between the upper and lower terminals cannot be achieved.

SUMMARY OF THE INVENTION

The present invention has been achieved in order to solve the problems mentioned above, and an object of the present invention is to provide a joint connector which can prevent a tab from being deformed at a time of being combined and can previously detect a combination error.

The first aspect of the invention provides a joint connector comprising: a plurality of terminals; a terminal receiving chamber in which the terminals are received and arranged; and a connector housing having the terminal receiving chamber in which a plurality of terminals are received and arranged, wherein the joint connector is constructed by combining a plurality of the connector housings having a uniform shape in plural stages so that the terminal receiving chamber side is set to a front surface, an opposite side is set to a back surface, and the back surface is overlapped with the front surface, wherein a front engaging member, a combining projection portion formed in the front engaging member, a rear engaging member, a front lock member and a front surface rear lock member are provided on the front surface, and a front engaging member inserting hole into which the front engaging member is inserted, a combining projection portion fitting hole to which the combining projection portion is fitted, a rear engaging member inserting hole into which the rear engaging member is inserted, a back surface rear lock member engaged with the front surface rear lock member and a tab inserting hole extending a tab formed in the terminal through the terminal receiving chamber are provided on the back surface, and wherein the combining projection portion is formed so that a part thereof is overlapped with the combining projection portion fitting hole, connector temporarily engaging surfaces are respectively formed in the front surface rear lock member and the back surface rear lock member, and in a temporarily placed state before the connector housings are combined, the combining projection portion comes into contact with an opening peripheral edge portion of the combining projection portion fitting hole and the respective connector temporarily engaged surfaces of the front surface rear lock member and the back surface rear lock member come into contact therewith, whereby each of the combined connector housings keeps a parallel state, and at least a front end of the tab is inserted into the tab inserting hole.

According to the first aspect of the invention, since in a temporarily placed state before the connector housings are combined, the combining projection portion comes into contact with an opening peripheral edge portion of the combining projection portion fitting hole, and the respective connector temporarily engaged surfaces of the front surface rear lock member and the back surface rear lock member come into contact therewith, so that each of the combined connector housings keeps a parallel state, and at least a front end of the tab is inserted into the tab inserting hole. Therefore, the front tab is smoothly inserted into the tab inserting hole without coming into contact with the opening peripheral edge portion of the tab inserting hole when the connector housings are going to be combined with each other from this parallel state.

The second aspect of the invention provides a joint connector according to the first aspect of the invention, wherein there is provided with a combination error detecting mechanism for detecting that the above overlapped connector housing is inclined, so as to generate a combination error in the case that the front end of the tab is previously bent in the temporarily placed state.

According to the second aspect of the invention, since there is provided with a combination error detecting mechanism for detecting that the above overlapped connector housing is inclined, so as to generate a combination error, in the case that the front end of the tab is previously bent, it is possible to recognize a combination error before combining.

DETAILED DESCRIPTION OF THE PREFERRED EMBODIMENT

A description will be given in detail of a particular embodiment to which the present invention is applied with reference to the accompanying drawings. The present embodiment corresponds to an embodiment of a joint connector in which two of the same connector housing are vertically overlapped with each other so as to be combined.

<A Structure of A Joint Connector>

Figure 1:
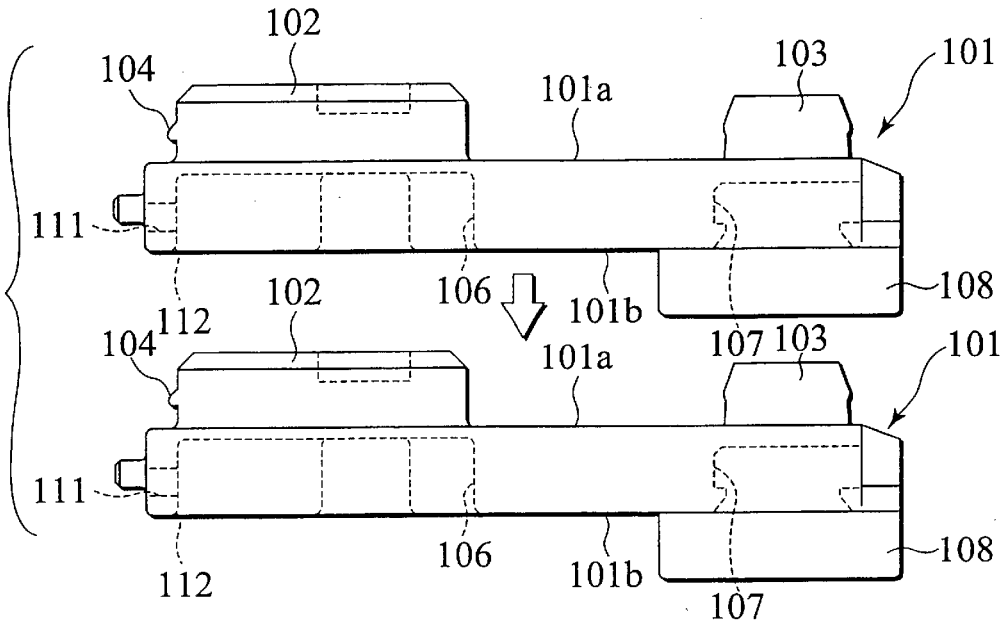
FIG. 1 is a side elevation view showing a state before combining proposed connector housings with each other.
Figure 2:
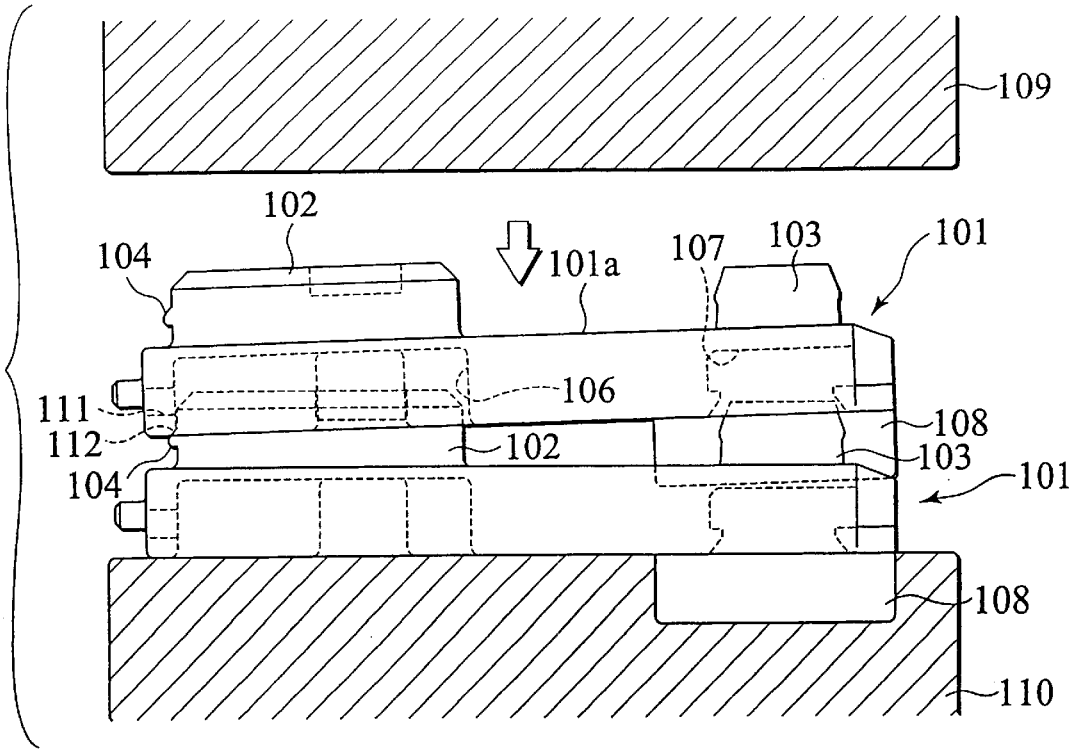
FIG. 2 is a side elevation view showing a state of combining the proposed connector housings with each other from a temporarily placed state.
Figure 3:
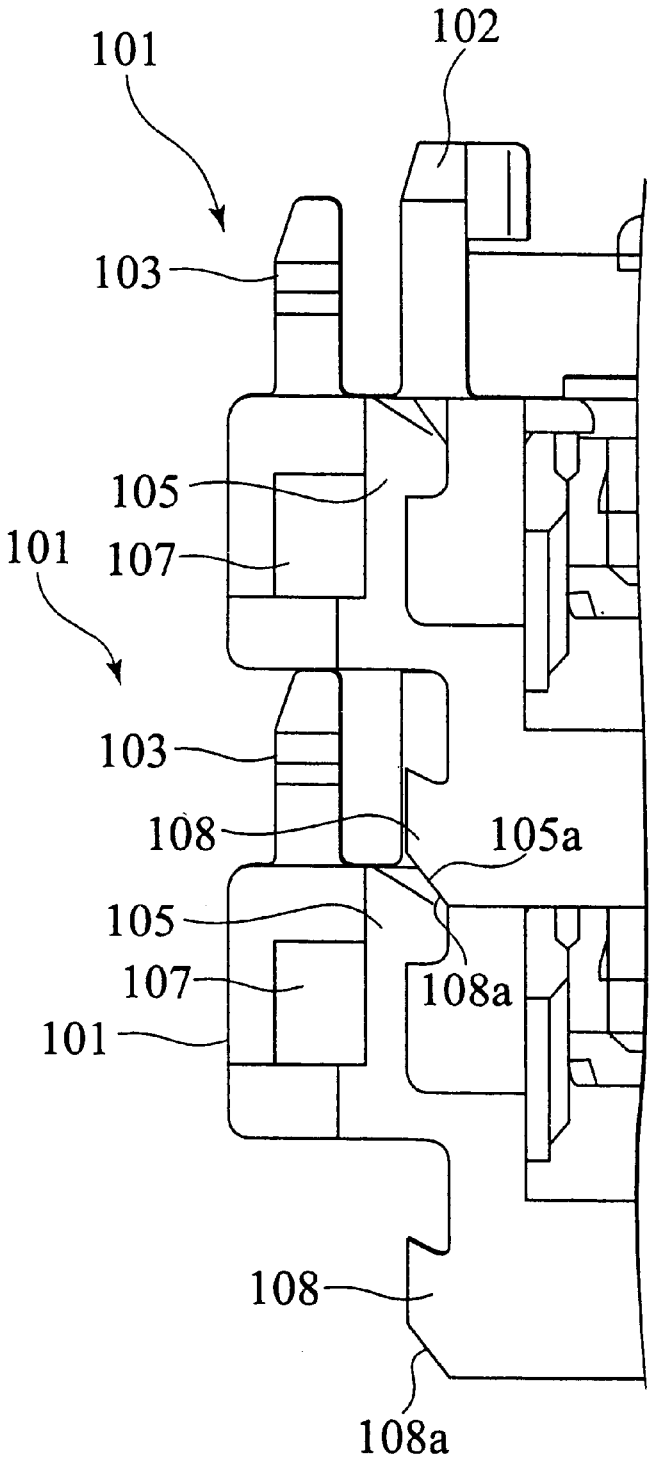
FIG. 3 is an enlarged front elevation view of a main portion of a housing rear portion in the temporarily placed state shown in FIG. 2.
Figure 4:
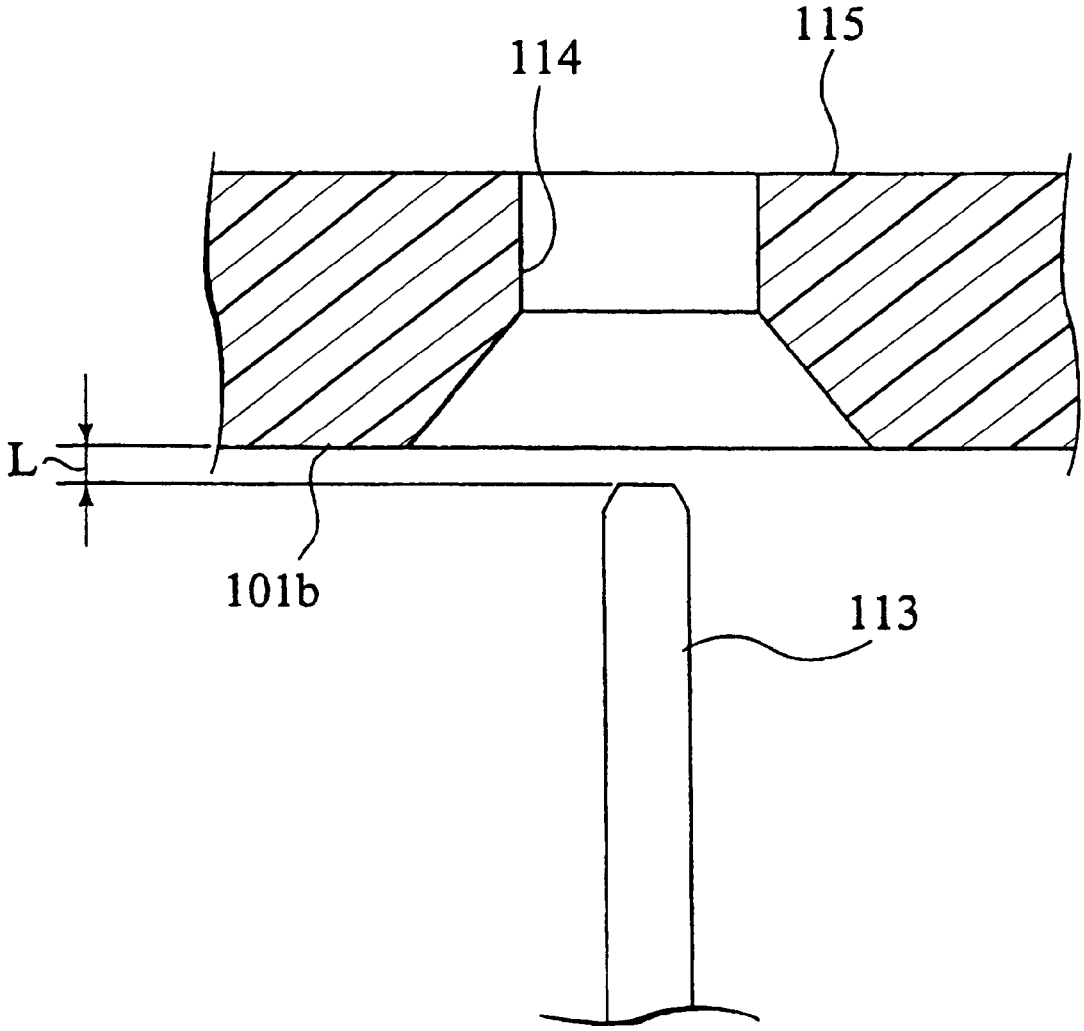
FIG. 4 is an enlarged cross sectional view of a main portion of a tab and a tab inserting hole portion in the temporarily placed state shown in FIG. 2.
Figure 5:
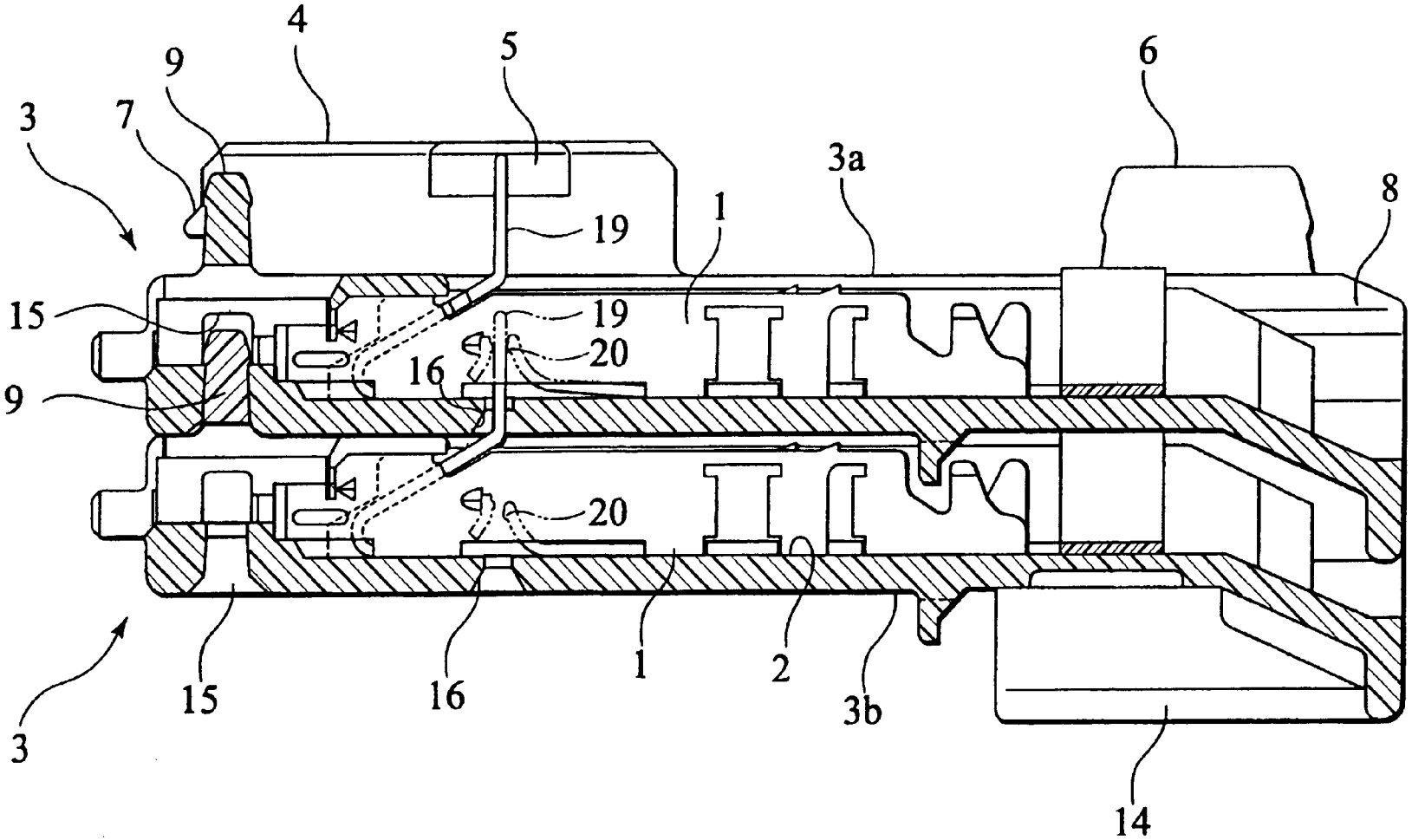
FIG. 5 is a cross sectional view of a joint connector in accordance with the present invention.

A joint connector in accordance with the present embodiment is structured, as shown in FIG. 5, such that connector housings 3 and 3 having a plurality of terminals 1 received and arranged in a terminal receiving chamber 2 and formed in the same shape are vertically combined with each other in two stages so that a side of the terminal receiving chamber 2 is set to a front surface 3*a*, and an opposite side is set to a back surface 3*b* and the back surface 3*b* is overlapped with the front surface 3*a*.

"A Connector Housing"

Figure 6:
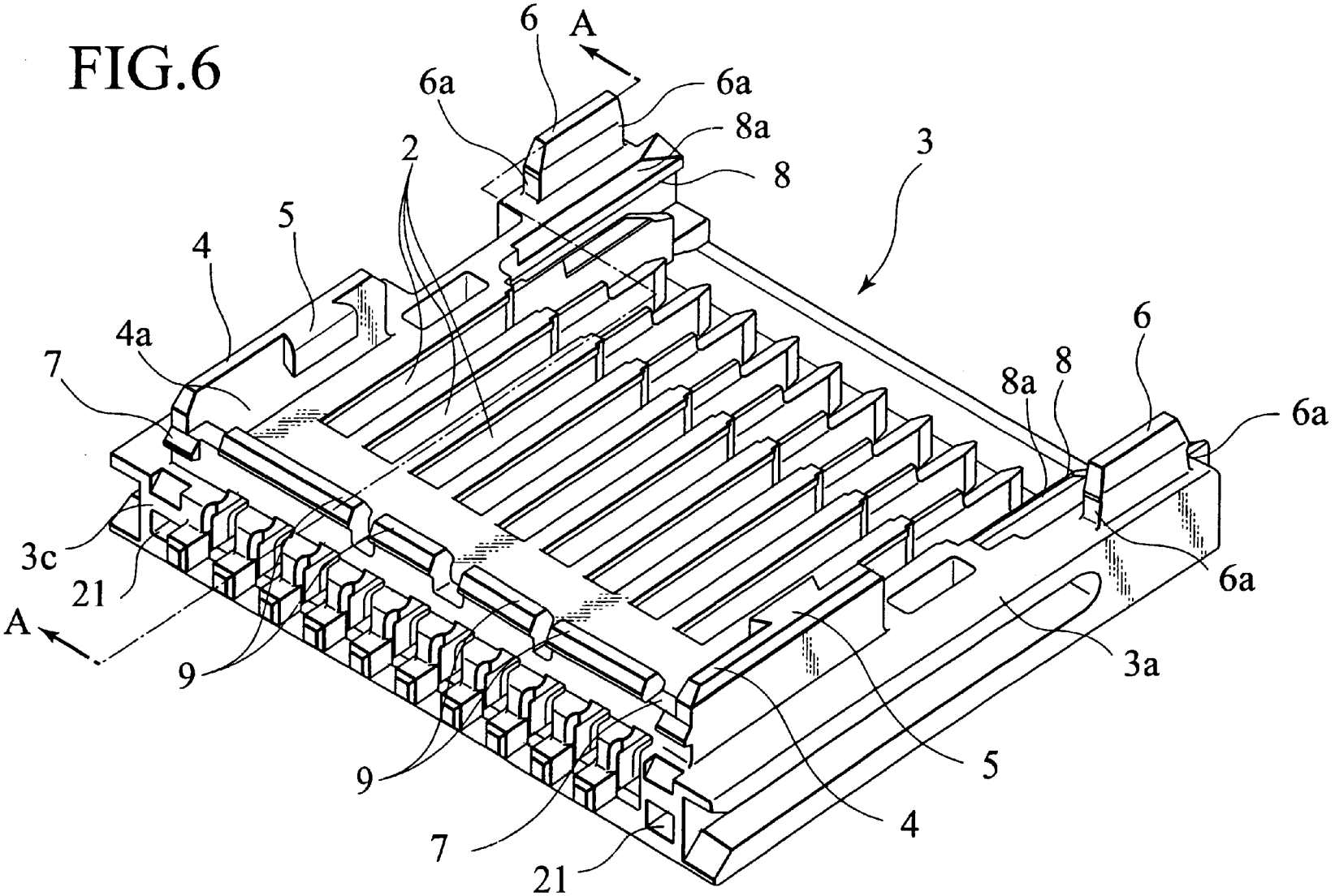
FIG. 6 is a perspective view showing a front surface of a connector housing.
Figure 8B:
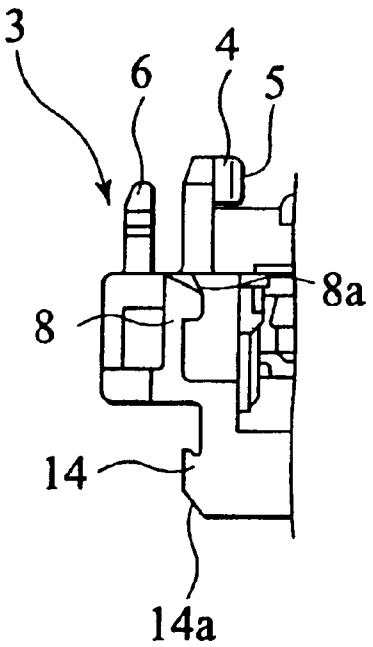
FIG. 8B is a front elevation view of a main portion of a housing rear portion in the connector housing.
Figure 8A:
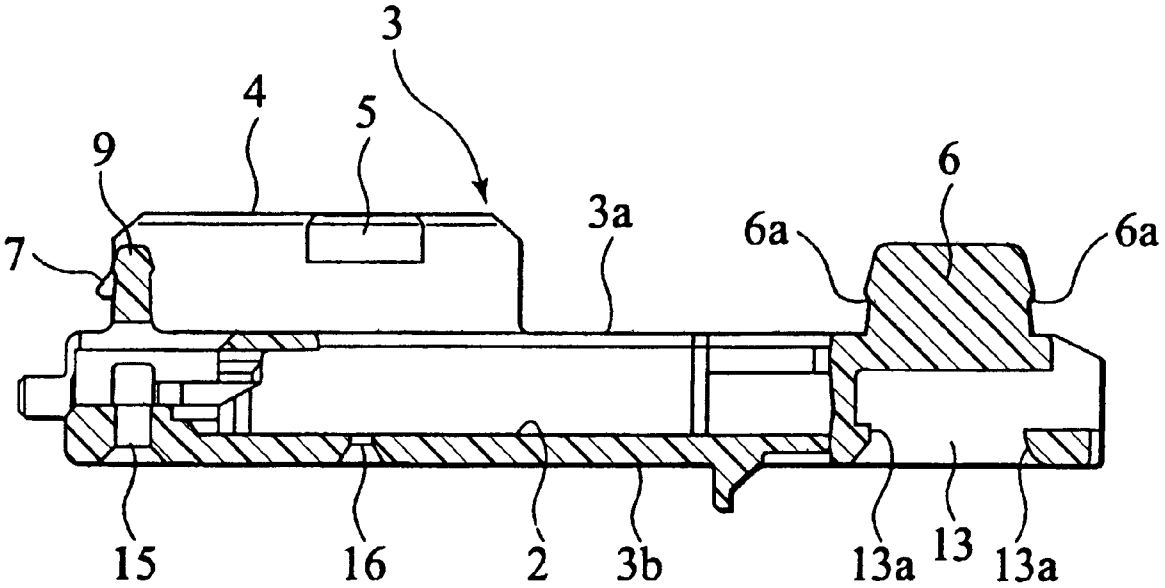
FIG. 8A is a vertical cross sectional view of the connector housing.

The connector housing 3 is formed as a rectangular housing having the terminal receiving chamber 2 which receives a plurality of terminals 1 at a predetermined interval, as shown in FIGS. 6, 8A and 8B. Further, the connector housing 3 is provided with a combining projection portion and a combining lock portion on the front surface 3*a* and the back surface 3*b*, respectively.

[A Connector Housing Front Surface]

On the front surface 3*a* of the connector housing 3, as shown in FIG. 6, there are provided a front engaging member 4, a combining projection portion 5 formed in the front engaging member 4, a rear engaging member 6, a front lock member 7, a front surface rear lock member 8 and a housing gap clogging member 9.

(a) A Front Engaging Member

The front engaging member 4 is protruded upward from connecting sides to the opposite connector and both side portions of the connector housing 3, respectively as rectangular pieces, as shown in FIGS. 6, 8A and 8B. The front engaging member 4 serves to prevent the housing front portion from being shaky in a longitudinal direction and a lateral direction.

(b) A Combining Projection Portion

The combining projection portion 5 is integrally formed in the front engaging member 4, as shown in FIGS. 6, 8A and 8B, and has a function of clogging the gap in the front and lateral directions between the connector housings 3. The combining projection portion 5 is formed at a position close to the front end of the front engaging member 4 so as to protrude to an inner surface 4*a* side of the front engaging member 4. A shape and a size of the combining projection portion 5 will be described later.

(c) A Rear Engaging Member

The rear engaging member 6 is protruded above the connector housings 3 as a rectangular piece from electric wire take-out sides taking out an electric wire (not shown) connected to the terminal 1 received in the terminal receiving chamber 2 and both side portions of the connector housing 3, as shown in FIGS. 6, 8A and 8B. The rear engaging member 6 is provided at a further outer position from the position forming the front engaging member 4, and serves to prevent the housing rear portion from being shaky in the longitudinal direction and the vertical direction.

(d) A Front Lock Member

The front lock member 7 is protruded from the connecting side with the opposite connector and the front end of the front engaging member 4, as shown in FIGS. 6, 8A and 8B. The front lock member 7 is formed as a projection having a substantially triangular cross section, and serves to lock a connecting state of the connector housing 3 in the housing front portion.

(e) A Front Surface Rear Lock Member

The front surface rear lock member 8 is formed in a base end side of the rear engaging member 6 and at a position below the front surface 3*a* of the connector housing 3, as shown in FIGS. 6, 8A and 8B. The front surface rear lock member 8 is, as shown in FIG. 8B, formed as a projection protruding into the connector housing 3, and serves to lock a connecting state of the connector housing 3 in the housing rear portion by being engaged with a back surface rear lock member 14 mentioned below. A connector temporarily engaging surface 8*a* corresponding to a taper surface which come into contact with a connector temporarily engaging surface 14*a* of the back surface rear lock member 14 mentioned below in a temporarily placed state before the connector housings 3 and 3 are combined is formed in the front surface rear lock member 8.

(f) A Housing Gap Clogging Member

A plurality of housing gap clogging member 9 are protruded from the connecting side to the opposite connector and in a direction substantially perpendicular to a connecting attaching direction, as shown in FIGS. 6, 8A and 8B. The housing gap clogging member 9 is, as shown in FIGS. 8A and 8B, inserted into and fitted to a housing gap clogging member inserting hole 15 mentioned below formed on the back surface 3*b* of the connector housing 3, thereby serving to clog the gap in a vertical direction between the connector housings 3 and 3.

[A Connector Housing Back Surface]

Figure 7:
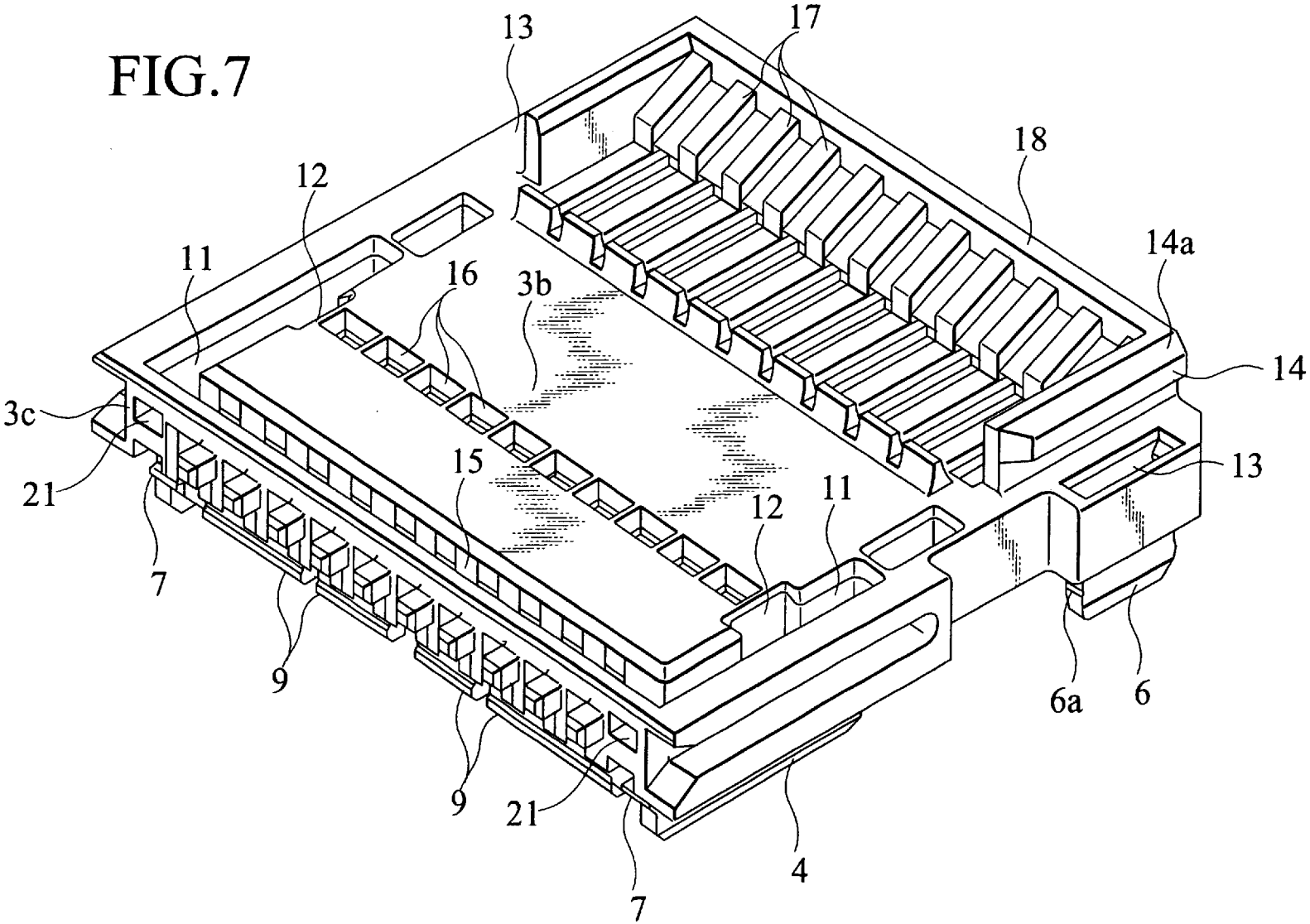
FIG. 7 is a perspective view showing a back surface of the connector housing.

On the back surface 3*b* of the connector housing 3, as shown in FIG. 7, there are provided a front engaging member inserting hole 11 into which the front engaging member 4 is inserted, a combining projection portion fitting hole 12 to which the combining projection portion 5 is fitted, a rear engaging member inserting hole 13 into which the rear engaging member 6 is inserted, a back surface rear lock member 14 engaged with the front surface rear lock member 8, a housing gap clogging member inserting hole 15 into which the housing gap clotting member 9 is inserted, a tab inserting hole 16, and a reinforcing rib 17.

(g) A Front Engaging Member Inserting Hole

The front engaging member inserting hole 11 is, as shown in FIGS. 7, 8A and 8B, formed as a stopper hole in a back side opposing to the front engaging member 4. The front engaging member 4 is inserted into the front engaging member inserting hole 11, whereby it is possible to prevent the housing front portion from being shaky in the longitudinal direction and the vertical direction by inserting the front engaging member 4 into the front engaging member inserting hole 11.

(h) A Combining Projection Portion Fitting Hole

Figure 9:
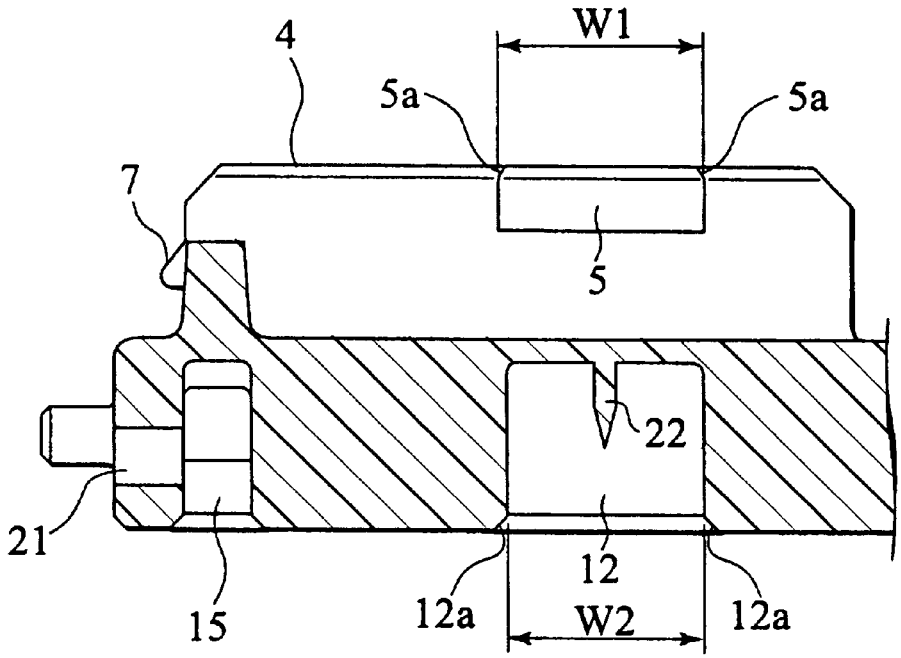
FIG. 9 is an enlarged vertical cross sectional view of a main portion showing a combining projection portion and a fitting hole portion of a combining projection portion of the connector housing in an enlarged manner.

The combining projection portion fitting hole 12 is, as shown in FIGS. 7 and 9, formed as a stopper hole in a back side opposing to the combining projection portion 5, and is connected to the front engaging member inserting hole 11. A combining force applying protruding portion 22 for applying an urging force to the combined combining projection portion 5 so as to increase a combining force between the connector housings 3 and 3, is formed on an inner wall of the of the combining projection portion fitting hole 12.

Figure 10:
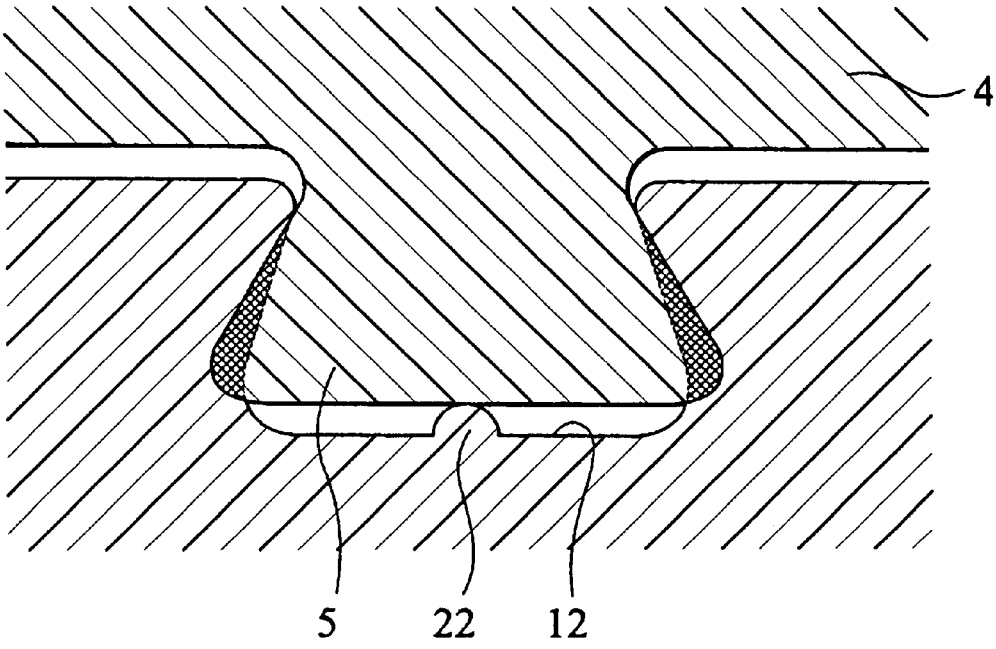
FIG. 10 is a horizontal cross sectional view showing the combining projection portion and the fitting hole portion of the combining projection portion of the connector housing in an enlarged manner.

The combining projection portion fitting hole 12 and the combining projection portion 5 are, as shown in FIG. 10, structured such that a part of the combining projection portion 5 is overlapped with the combining projection portion fitting hole 12 (an area shown by a hatched portion in FIG. 10). That is, as shown in FIG. 9, a width W1 of the combining projection portion 5 is set to a slightly larger size than an opening width W2 of the combining projection portion fitting hole 12, and the combining projection portion 5 is fitted to the combining projection portion fitting hole 12 so as to expand the combining projection portion fitting hole 12 at a degree of the overlapped portion when the connector housings 3 and 3 are combined in an overlapping manner.

Figure 13:
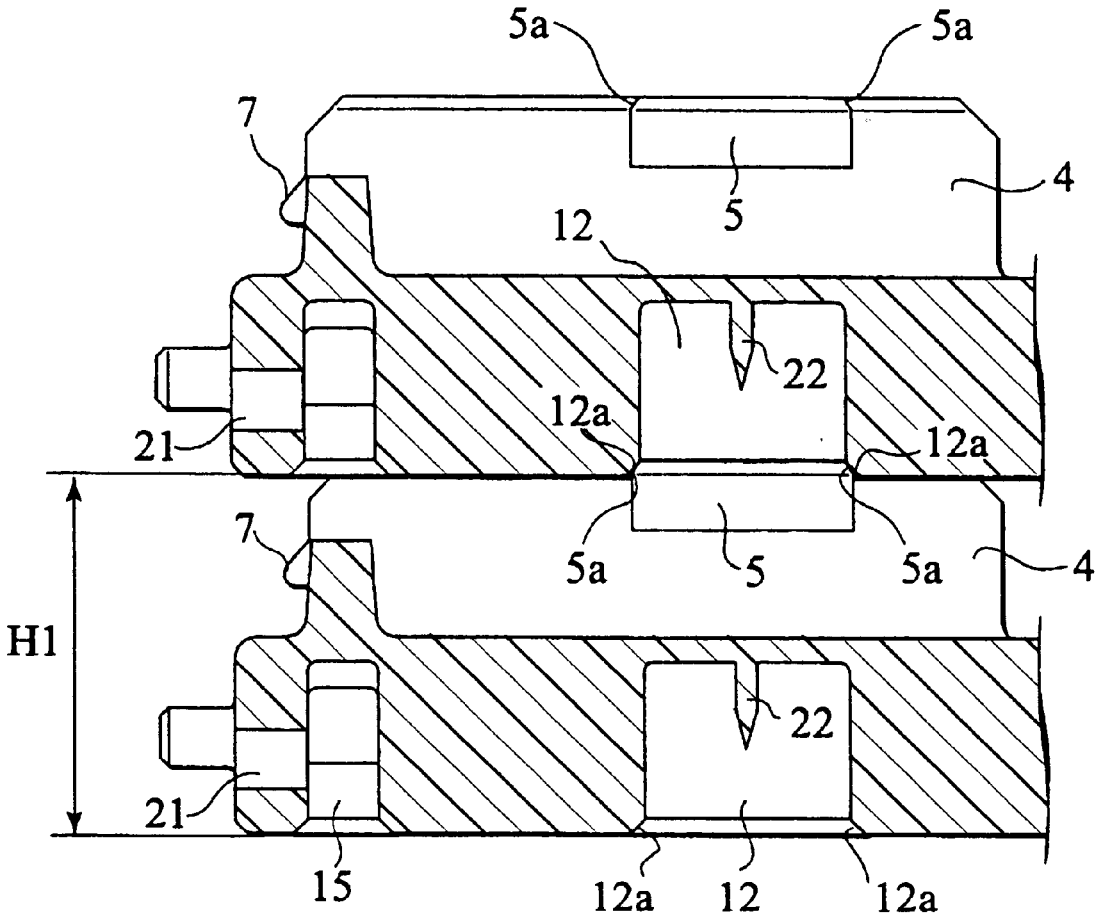
FIG. 13 is an enlarged vertical cross sectional view of a main portion of a housing front portion of the connector housing in the temporarily placed state.

Further, as shown in FIG. 13, in a temporarily placed state before the connector housings 3 and 3 are combined, both front end portions 5*a* and 5*a* (refer to FIG. 9) formed in an R shape of the combining projection portion 5 come into contact with opening both end portions 12*a* and 12*a* (refer to FIG. 9) formed as a taper surface in the combining projection portion fitting hole 12. The both front end portions 5*a* and 5*a* come into contact with the opening both end portions 12*a* and 12*a*, so that a height H1 in front of the housing (hereinafter, refer to as a housing front height H1) of the connector housing 3 is determined.

(i) A Rear Engaging Member Inserting Hole

The rear engaging member inserting hole 13 is, as shown in FIGS. 7, 8A and 8B, formed as a stopper hole in a back side opposing to the rear engaging member 6. A step portion 6*a* formed in the rear engaging member 6 is engaged with the rear engaging member inserting hole 13, and a flange portion 13*a* is formed in the rear engaging member inserting hole 13, so that the flange portion 13*a* prevents the rear engaging member 6 from being taken out from the rear engaging member inserting hole 13.

(j) A Back Surface Rear Lock Member

Figure 12:
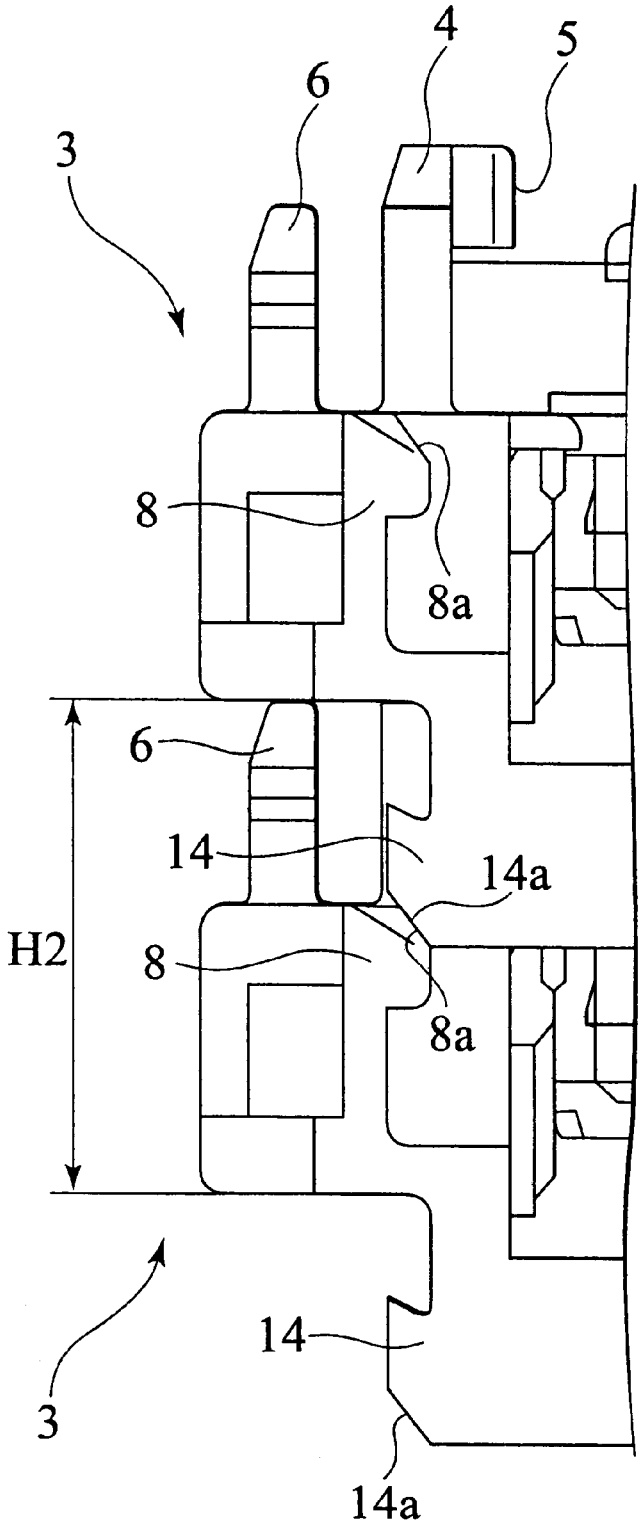
FIG. 12 is an enlarged front elevation view of a main portion of the housing rear portion of the connector housing in the temporarily placed state.

The back surface rear lock member 14 is, as shown in FIGS. 7, 8A and 8B, formed in a back side opposing to the front surface rear lock member 8. The back surface rear lock member 14 is protruded in an upper end side of a peripheral wall 18 formed in a substantially U shape so as to surround an outer periphery of the reinforcing rib 17. In the back surface rear lock member 14, there is formed a connector temporarily engaging surface 14*a* corresponding to a taper surface which comes into contact with a connector temporarily engaging surface 8*a* of the front surface rear lock member 8 in accordance with a surface contact, in the temporarily placed state before the connector housings 3 and 3 are combined. The respective connector temporarily engaging surfaces 8*a* and 14*a* of the front surface rear lock member 8 and the back surface rear lock member 14 come into contact with each other, so that a height H2 at the back of the housing (hereinafter, refer to as a housing rear height H2) of the connector housing 3 is determined as shown in FIG. 12.

In the temporarily placed state of the connector housing 3, the housing front height H1 and the housing rear height H2 are equal to each other. Accordingly, the upper and lower connector housings 3 and 3 hold a parallel state without being inclined.

(k) A Housing Gap Clogging Member Inserting Hole

The housing gap clogging member inserting hole 15 is, as shown in FIGS. 7, 8A and 8B, formed in a back side opposing to the housing gap clogging member 9. Further, the housing gap clogging member 9 is inserted into and fitted to the housing gap clogging member inserting hole 15 connected to both the front engaging member inserting holes 11 so as to be wholly formed in a substantially U-shaped hole. Therefore, the gap in the vertical direction between the connector housings 3 and 3 can be clogged.

(l) A Tab Inserting Hole

The tab inserting hole 16 is, as shown in FIGS. 7, 8A and 8B, formed as an opening for inserting a tab 19 (refer to FIG. 5) formed in the terminal 1 into the terminal receiving chamber 2. The tab inserting hole 16 is structured such that an opening width is expanded like a skirt in the back surface 3*b* side, thereby the tab 19 is smoothly inserted. Then, the tab 19 inserted into the terminal receiving chamber 2 from the tab inserting hole 16 is in contact with a tab contact portion 20 formed in the terminal 1, as shown in FIG. 5, thereby electrically conducting the upper and lower terminals 1 and 1 with each other.

(m) A Reinforcing Rib

The reinforcing rib 17 is, as shown in FIG. 7, formed and arranged as rectangular piece in the housing rear portion, and serves to improve a mechanical strength of the connector housing 3. Then, in order to make it hard that the vibration from the electric wire is transmitted to the contact portion in the tab contact portion 20 so as to protect the tab contact portion 20, the portion, in which the reinforcing rib 17 is formed, is in a tapered bent shape.

[A Connector Housing Head Surface]

A front lock member engaging hole 21 which the front lock member 7 is inserted into and engaged with is formed on the front surface 3*c* of the connector housing 3, as shown in FIGS. 6 and 7. The front lock member 7 is inserted into and engaged with the front lock member engaging hole 21, whereby a connecting state of the connector housing 3 in the housing front portion is locked.

<A Combining Operation of Connector Housings>

Next, a description will be given of a combining method of the connector housings 3 and 3. At first, the terminal 1 connected to one end of the electric wire is arranged in each of the terminal receiving chambers 2 of the connector housing 3. Next, as shown in FIGS. 11A and 11B, these connector housings 3 and 3 are made in a temporarily placed state by overlapping the back surface 3*b* of another connector housing 3 on the front surface 3*a* of one connector housing 3.

In the housing front portion in the temporarily placed state, since a part of the combining projection portion 5 is overlapped with the combining projection portion fitting hole 12 as shown in FIG. 10, the combining projection portion 5 is made in a state of coming into contact with the opening peripheral edge portion of the combining projection portion fitting hole 12. Further, as shown in FIG. 13, the front end portions 5*a* and 5*a* of the combining projection portion 5 come into contact with the opening both end portions 12*a* and 12*a* of the combining projection portion fitting hole 12 so as to keep the housing front height H1. On the contrary, in the housing rear portion in the temporarily placed state, as shown in FIG. 12, the respective connector temporarily engaging surfaces 8*a* and 14*a* of the front surface rear lock member 8 and the back surface rear lock member 14 come into contact with each other so as to keep the housing rear height H2.

Figure 11B:
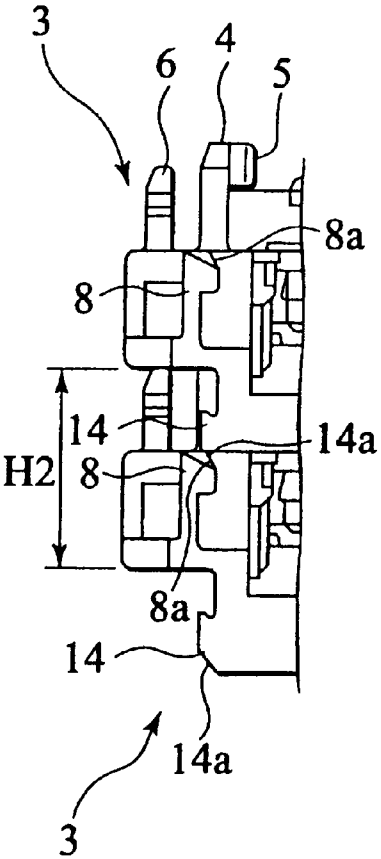
FIG. 11B is a front elevation view of a main portion of a housing rear portion of the connector housing in the temporarily placed state.
Figure 11A:
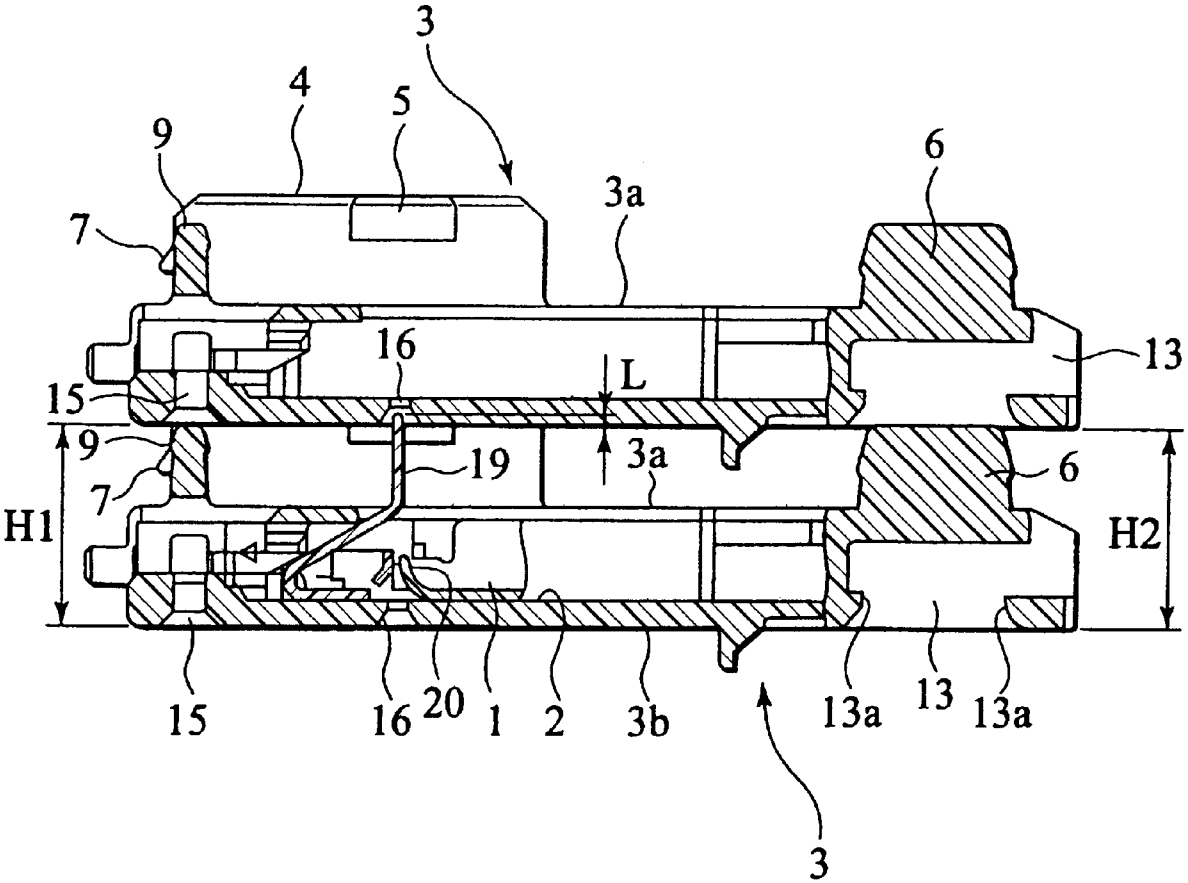
FIG. 11A is a vertical cross sectional view of the connector housing in the temporarily placed state.

In the temporarily placed state, since the housing front height H1 and the housing rear height H2 are equal to each other, the connector housings 3 and 3 keep a parallel state, as shown in FIGS. 11A and 11B. Further, in this temporarily placed state, as shown in FIGS. 11A and 11B, the front end of the tab 19 is in a state of being inserted into the tab inserting hole 16 at a predetermined length L.

Next, the connector housings 3 and 3 in the temporarily placed state are pressed to each other from a vertical direction by using a combining jig (not shown). Then, in the housing front portion, the front engaging member 4 enters in the front engaging member inserting hole 11, the combining projection portion 5 enters in the combining projection portion fitting hole 12, the front lock member 7 enters in the front lock member engaging hole 21, the housing gap clogging member 9 enters in the housing gap clogging member inserting hole 15, and the tab 19 enters in the tab inserting hole 16, respectively. In the housing rear portion, the rear engaging member 6 enters in the rear engaging member inserting hole 13 and the front surface rear lock member 8 is engaged with the back surface rear lock member 14.

Accordingly, in both of the connector housings 3 and 3, the front lock member 7 is inserted into and engaged with the front lock member engaging hole 21 so as to lock the housing front portion, the front surface rear lock member 8 and the back surface rear lock member 14 are engaged with each other so as to lock the housing rear portion. Then, each of the terminals 1 of the connector housings 3 and 3 combined in the vertical direction is conducted in accordance that the tab 19 is in contact with the tab contact portion 20. In accordance with the above operations, the joint connector is completed.

In accordance with the joint connector of the present embodiment, in the temporarily placed state, since the combined connector housings 3 and 3 keep a parallel state, the front engaging member 4 and the rear engaging member 6 are smoothly inserted into and engaged with the front engaging member inserting hole 11 and the rear engaging member inserting hole 13, respectively without unnaturally coming into contact with when combining the connector housings 3 and 3 with each other from this parallel state, so that the upper and lower connector housings 3 and 3 are combined without being inclined. Accordingly, it is possible to avoid the combining error such as the damage of the combining portion, the incomplete combination or the like.

Further, since the front end of the tab 19 enters in the tab inserting hole 16 in the temporarily placed state, the tab 19 is smoothly inserted into the tab inserting hole 16 without being in contact with the opening peripheral edge portion of the tab inserting hole 16, so that it is possible to secure an electric conduction between the upper and lower terminals. For example, in the case that the front end of the tab 19 is previously bent in the temporarily placed state, since the tab 19 comes into contact with the back surface 3*b* of the connector housing 3 and the above overlapped connector housing 3 is inclined (that is, the combination error detecting mechanism), the combining error can be detected. Since the combining error can be detected before being combined, it is possible to stop the combining operation before the error, so that it is possible to previously prevent an inferior product from being produced.

As mentioned above, the description is given of the particular embodiments to which the present invention is applied. However, the present invention can be variously modified without being limited to the embodiments.

For example, in the embodiments mentioned above, two connector housings 3 and 3 are combined in a vertical direction, however, the present invention can be applied to the case that three, four or more connector housings 3 are combined with one another, and the same effects can be obtained in this case. In particular, when overlapping the connector housings 3 and 3 in plural stages, the incline of the housing is further enlarged, so that it is possible to avoid the incline of the housing by applying the present invention.

What is claimed is:

1. A joint connector having a plurality of terminals, a terminal receiving chamber in which said terminals are received and arranged and a connector housing including the terminal receiving chamber in which a plurality of said terminals are received and arranged, the joint connector comprising:

a front surface defined as a side to which said terminal receiving chamber side is set; and a back surface defined as a side which is opposite to said front surface wherein the joint connector is constructed by combining a plurality of said connector housings having a uniform shape in plural stages so that said back surface is overlapped with said front surface, wherein said front surface comprises:

(a) a front engaging member protruded above said connector housing from connecting sides to an opposite connector and both side portion of said connector housing, respectively as rectangular pieces;

(b) a combining projection portion integrally formed at a position close to a front end of said front engaging member so as to protrude to an inner surface side of said front engaging member;

(c) a rear engaging member protruded above said connector housing as a rectangular piece from electric wire take-out sides and both side portions of said connector housing;

(d) a front lock member protruded as a triangular cross section piece from said connecting side with said opposite connector and said front end of said front engaging member; and (e) a front surface rear lock member protruded into said connector housing and formed in a base end side of said rear engaging member and at a position below said front surface; opposite connector and in a direction substantially perpendicular to a connecting attaching direction, said back surface comprises:

(g) a front engaging member inserting hole formed as a stopper hole in a back side opposing to said front engaging member;

(h) a combining projection portion fitting hole formed as a stopper hole in a back side opposing to said combining projection portion and connected to said front engaging member inserting hole;

(i) a rear engaging member inserting hole formed as a stopper hole in a back side opposing to said rear engaging member;

(j) a back surface rear lock member formed in a back side opposing to said front surface rear lock member and protruded in an upper end side of a peripheral wall;

(k) a housing gap clogging member inserting hole formed in a back side opposing to said housing gap clogging member;

(l) a tab inserting hole formed as an opening and expanded like a skirt; and (m) a reinforcing rib formed and arranged as a rectangular piece in a housing rear portion, and improving a mechanical strength of said connector housing, wherein said combining projection portion is formed so that a part thereof is overlapped with said combining projection portion fitting hole, connector temporarily engaging surfaces are respectively formed in said front surface rear lock member and said back surface rear lock member, and wherein in a temporarily placed state before said connector housings are combined, said combining projection portion comes into contact with an opening peripheral edge portion of said combining projection portion fitting hole and said respective connector temporarily engaged surfaces of said front surface rear lock member and said back surface rear lock member come into contact therewith, whereby each of said combined connector housings keeps a parallel state, and at least a front end of said tab is inserted into said tab inserting hole.

2. A joint connector as claimed in claim 1, wherein there is provided with a combination error detecting mechanism for detecting that an above overlapped connector housing is inclined, so as to generate a combination error in the case that the front end of said tab is previously bent in said temporarily placed state.

3. A joint connector as claimed in claim 1 further comprising:

a head surface, wherein said front lock member is inserted into and engaged with said front lock member engaging hole, so that said connecting state of said connector housing in a housing front portion is locked.

4. A joint connector as claimed in claim 1, wherein said front engaging member is inserted into said front engaging member inserting hole.

5. A joint connector as claimed in claim 1, wherein said combining projection portion is fitted to said combining projection portion fitting hole.

6. A joint connector as claimed in claim 1, wherein said rear engaging member is inserted into said rear engaging member inserting hole.

7. A joint connector as claimed in claim 1, wherein said front surface rear lock member is engaged with said back surface rear lock member.

8. A joint connector as claimed in claim 1, wherein said housing gap clogging member is inserted into and fitted to said housing gap clogging member inserting hole and connected to both said front engaging member inserting holes.

9. A joint connector as claimed in claim 1, wherein a tab formed in said terminal through said terminal receiving chamber is inserted into said tab inserting hole.

10. A joint connector as claimed in claim 1, wherein a width of said combining projection portion is set to a slightly larger size than an opening width of said combining projection portion fitting hole.

11. A joint connector as claimed in claim 1, wherein in said temporarily placed state of said connector housing, a housing front height H1 and a housing rear height H2 are equal to each other.

* * * * *